US012690686B2

(12) United States Patent
Meier

(10) Patent No.: US 12,690,686 B2
(45) Date of Patent: Jul. 28, 2026

(54) MULTIFUNCTIONAL LOUNGE CHAIR ASSEMBLY

(71) Applicant: Stephanie Meier, Miami, FL (US)

(72) Inventor: Stephanie Meier, Miami, FL (US)

( * ) Notice: Subject to any disclaimer, the term of this patent is extended or adjusted under 35 U.S.C. 154(b) by 131 days.

(21) Appl. No.: 18/777,914

(22) Filed: Jul. 19, 2024

(65) Prior Publication Data

US 2026/0020673 A1 Jan. 22, 2026

(51) Int. Cl.

| | |
|---|---|
| ***A47C 1/14*** | (2006.01) |
| ***A47C 7/66*** | (2006.01) |
| ***A47C 7/72*** | (2006.01) |
| ***A47C 7/74*** | (2006.01) |
| ***A47C 31/00*** | (2006.01) |
| ***A47C 31/11*** | (2006.01) |

(52) U.S. Cl.

CPC ..... *A47C 1/143* (2013.01); *A47C 7/664* (2018.08); *A47C 7/723* (2018.08); *A47C 7/744* (2013.01); *A47C 31/11* (2013.01); *A47C 31/008* (2013.01)

(58) Field of Classification Search

CPC ..... A47C 1/143; A47C 7/664; A47C 7/744; A47C 7/723; A47C 31/11; A47C 31/008

USPC ..... 297/180.15

See application file for complete search history.

(56) References Cited

U.S. PATENT DOCUMENTS

| | | | | |
|---|---|---|---|---|
| 5,000,384 A * | 3/1991 | Arnold | A47C 7/664 239/289 |
| 5,322,342 A * | 6/1994 | Gange | A47C 1/143 239/289 |
| 7,175,231 B2 * | 2/2007 | Gallo | A47C 7/38 297/228.11 |
| 8,864,221 B1 * | 10/2014 | Delvilla | A47C 7/5066 297/180.12 |
| 9,175,496 B2 * | 11/2015 | Darquea | E04H 15/003 |

* cited by examiner

*Primary Examiner* — Milton Nelson, Jr.
(74) *Attorney, Agent, or Firm* — The Rapacke Law Group, P.A.

(57) ABSTRACT

A multifunctional lounge chair is disclosed, including a frame and a padding positioned on the frame. An umbrella is adjustably mounted to the frame. A misting system emits a mist to an environment near the frame. A first towel roller transports a clean towel over the surface of the padding and a second towel roller transport a dirty towel off of the surface of the padding. A tablet provide a user interface to enable to control a plurality of operational functions of the multifunctional lounge chair and enable the communication with an ordering system.

20 Claims, 4 Drawing Sheets

MULTIFUNCTIONAL LOUNGE CHAIR ASSEMBLY

TECHNICAL FIELD

The embodiments disclosed herein generally relate to furniture and more specifically to a multifunctional lounge chair.

BACKGROUND

Lounge chairs are commonly used near pools, on patios, gardens, and at beaches to provide a comfortable seat for relaxing outdoors. In particular, sun loungers, chaise lounges, and similar chairs include an adjustable back to enable the user to lie down or sit up in a reclined position. It is common for these chairs to have other furniture nearby to enhance relaxation, including umbrellas for providing shade, and tables for holding drinks and other items.

It is common that the user will bring a towel to cover the lounge chair, as they are often not sufficiently cleaned between uses. This is especially common in public settings to avoid cross-contamination between individuals. Covering the lounge chair with a towel can also provide a barrier between the user and the potentially hot surfaces of the lounge chair, especially if the lounge chair has been unoccupied and left in direct sunlight.

Improvements to lounge chairs have been focused the appearance of the lounge chair to suit various aesthetics, improving materials, and altering the padding and upholstery to enhance comfort. In some existing products, side tables and beverage holders have been added for convenience. While useful, opportunity exists for further developing the lounge chair.

SUMMARY OF THE INVENTION

This summary is provided to introduce a variety of concepts in a simplified form that is further disclosed in the detailed description of the embodiments. This summary is not intended for determining the scope of the claimed subject matter.

The embodiments provided herein relate to a multifunctional lounge chair including a frame and a padding positioned on the frame. An umbrella is adjustably mounted to the frame. A misting system emits a mist to an environment near the frame. A first towel roller transports a clean towel over the surface of the padding and a second towel roller transport a dirty towel off of the surface of the padding. A tablet provide a user interface to enable to control a plurality of operational functions of the multifunctional lounge chair and enable the communication with an ordering system.

The multifunctional lounge chair may be in operable communication with a computer system to operate an application program. The application program enables the user to navigate and operate the order system to place an order for a food, beverage, or other good or service provided by a service provider (e.g., a hotel, restaurant, bar, etc.). The application program also enables the user to adjust position of the frame, operate the towel motors to dispense or remove towels, to operate the pump and misting system, adjust the umbrella, and other functions of the multifunctional lounge chair. In such, the application program and tablet provides a convenient means for operating the system and communicating with the service provider. This increases the user's relaxation and access to service.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
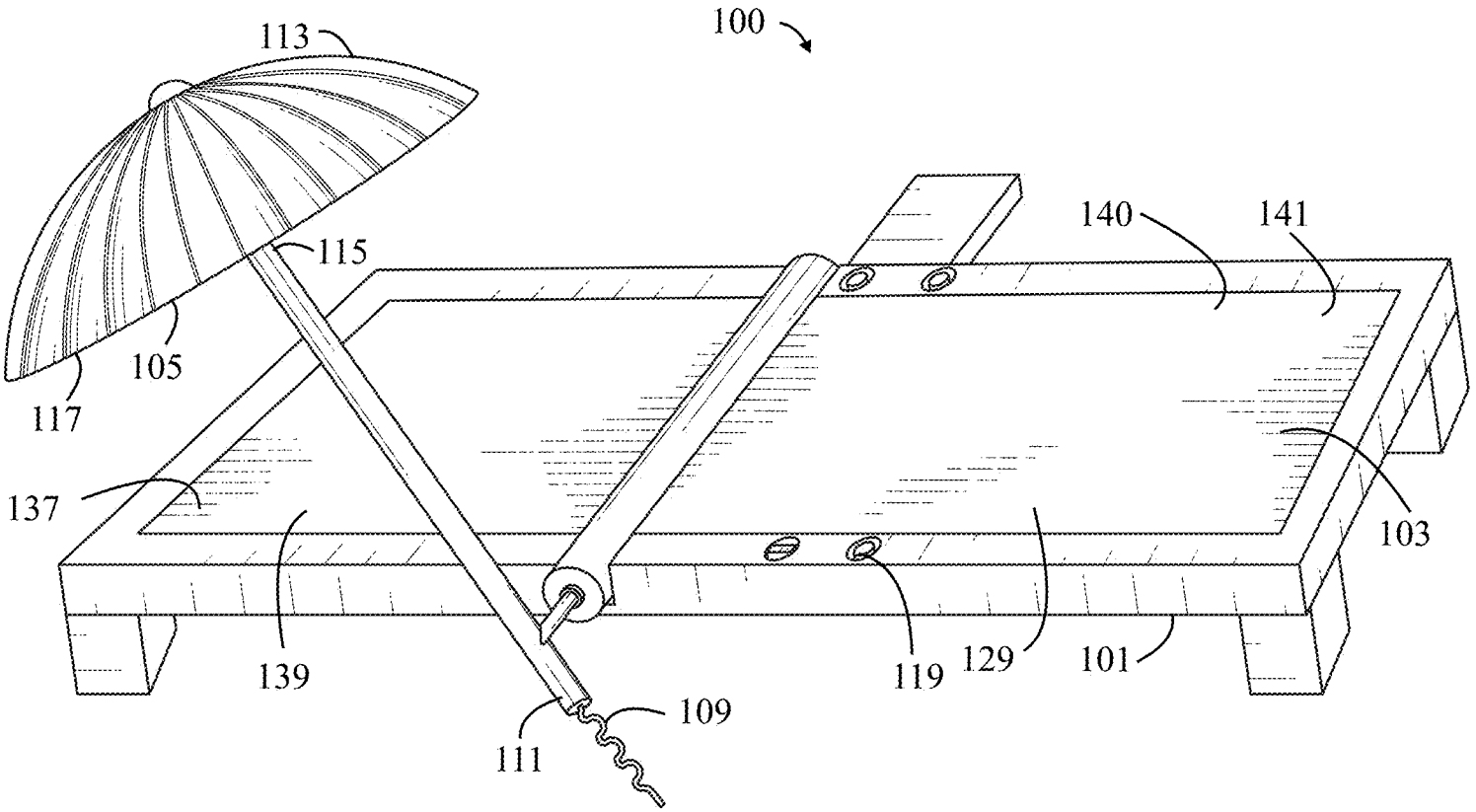
FIG. 1 illustrates a perspective view of the multifunctional lounge chair, according to some embodiments.

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing in detail exemplary embodiments, it is noted that the embodiments reside primarily in combinations of components related to particular devices and systems. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to multifunctional lounge chair assembly which is constructed as a lounge chair having various operational features to enhance the comfort of the user of the chair. The multifunctional lounge chair is capable of being operating, at least in part, by a computing device in operable communication with an application program. The tablet, via the application program, provides a user interface to enable the user to select and adjust various operational features including adjusting the position of the back of the multifunctional lounge chair, operating a clean towel roller, operating a dirty towel roller, operating a misting system, operating an umbrella system, and operating a massage system. The tablet may also be in communication with an ordering system to allow the user to order a good or service (e.g., a food item or a beverage item) from a service provider (such as ordering from hotel or bar staff, a restaurant, etc.).

Figure 2:
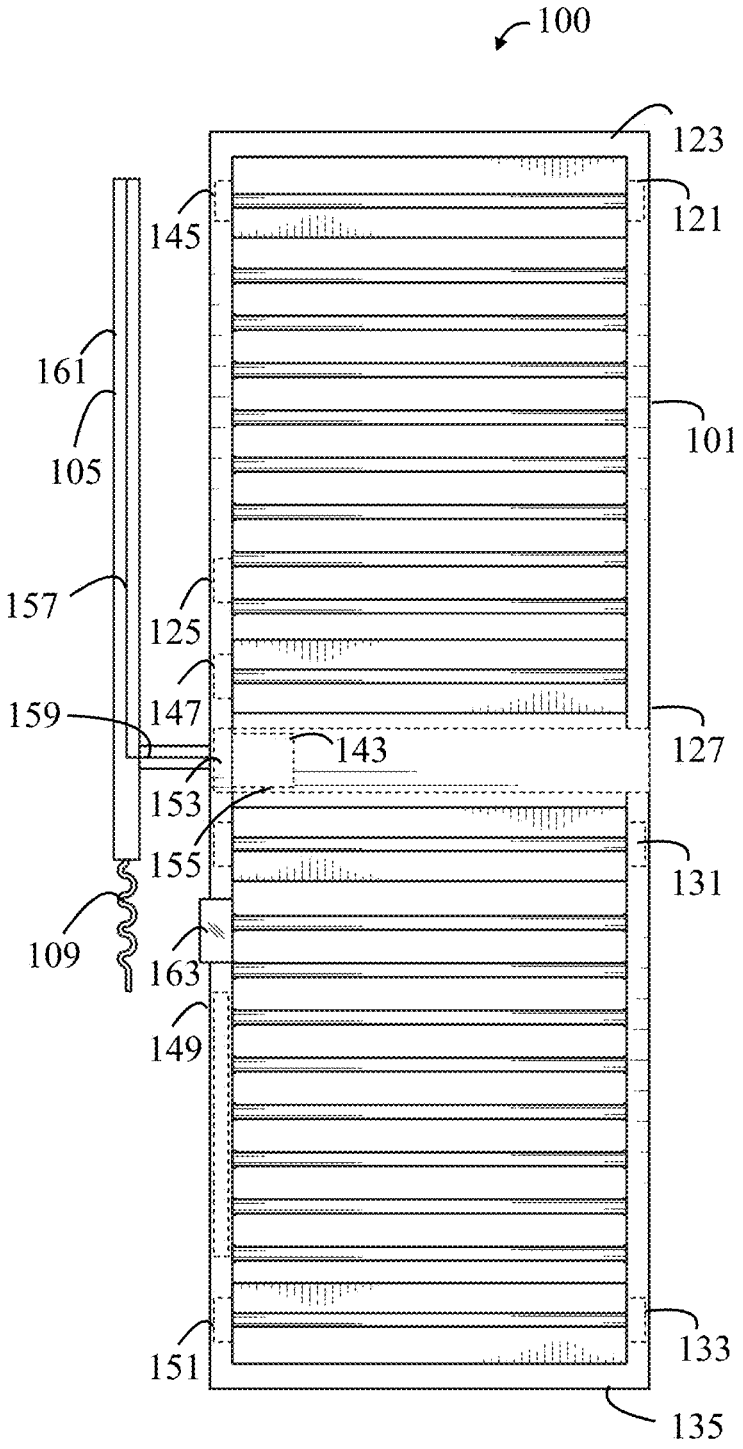
FIG. 2 illustrates a schematic of the multifunction lounge chair assembly components, according to some embodiments.

FIG. 1 and FIG. 2 illustrate the multifunctional lounge chair 100 which is comprised of a frame 101 providing a rigid structure capable of supporting to the weight of a human lying on the multifunctional lounge chair 100. A padding 103 is positioned on the frame 101 to provide a comfortable surface whereon the user sits or lies down. An umbrella 105 is adjustable mounted to the frame 101 via an umbrella motor which enables the orientation of the umbrella to be changed as needed based on the suns position, wind direction, for privacy, or other user preferences. The umbrella 105 may include a stake 109 provided on a bottom end 111 which is insertable into the ground surface to retain the umbrella in a fixed position. A canopy 113 extends from the top end 115 of the umbrella 105 to provide shade and protection from the elements (e.g., wind, rain, debris, and sun exposure). The umbrella 105 includes at least one water line to deliver water from a water reservoir to a plurality of sprayers 117 to emit a mist therefrom. The sprayers 117 are positioned to emit the mist over a user sitting or lying on the multifunctional lounge chair.

In further reference to FIG. 1, a display 119 is provided which is in operable communication with a computing device (i.e., a tablet or other smart device). The display 119 provides a user interface to enable the user to select various operational functions of the multifunctional lounge chair 100.

As used herein, "operational functions" of the multifunctional lounge chair 100 relates to various functions provided by the features of the components described herein. In one example, an operation function may include operating the first towel roller to roll a clean towel onto the surface of the padding. Following use, the user may also select to operate the second towel roller to remove the dirty towel from the surface of the padding. In another example, the user may select to turn on the misting system, adjust the output of the misting system, or to turn off the misting system. In another example, the user may turn on the massage system, turn off the massage system, or adjust the output settings of the massage system. In yet another example, the user may adjust the orientation of the umbrella.

In some embodiments, the user may utilize the display 119 to communicate with an ordering system associated with a service provider such as a hotel, restaurant, bar, etc.

In some embodiments, the system may include a AI-enabled computer system which enables voice communication through the display 119 and tablet.

In some embodiments, the tablet may include a communication system to allow the user to communication with emergency personnel, lifeguards, service providers, etc. The tablet may also enable the user to reserve local amenities such making restaurants reservations, reserving watersports activities, etc.

In some embodiments, the multifunctional lounge chair may include speakers to emit an audible tone to deter birds or other animals.

In some embodiments, the display 119 may be utilized to view statuses for each of the operation functions of the system, such as a water level within the water reservoir.

In some embodiments, the display 119 may be utilized to input a method for payment for a good or service, or to otherwise communicate with the service provider.

In some embodiments and in reference to FIG. 2, a first towel roller 121 is positioned at a first end 123 of the frame 101 and a second towel roller 125 is positioned above the central portion 127 of the frame 101. The first towel roller is operable to transfer a first (clean) towel over the surface 129 of the padding 103. Following use, the first clean towel is now dirty and the second towel roller 125 removes the first (dirty) towel from covering the surface 129 of the padding 103. A third towel roller 131 is positioned below the central portion 127 and a fourth towel roller 133 is positioned at the second end 135 of the frame 101. The third towel roller 131 is operable to transfer a second (clean) towel over the surface 129 of the padding 103. Following use, the second clean towel is now dirty and the fourth towel roller 133 removes the second (dirty) towel from covering the surface of the padding 103.

In some embodiments, the padding 103 includes an upper padding 137 and a lower padding 139. The upper padding 137 is positioned on the top portion 139 of the frame 101 and the lower padding 140 is positioned on the bottom portion 141 of the frame 101. In such, the upper padding 137 provides comfort to the user's head and torso while the lower padding provides comfort to the user's buttocks, waist, legs, and feet. The upper padding 139 and lower padding 140 are separated by the central portion 127 which pivots between a flat configuration and a reclined or upright configuration depending on the user's preferences. Pivoting the central portion 127 may be performed manually, or via the use of a frame motor 143 operating a gear system to pivot the frame 101 into the desired position.

In some embodiments, towel roller motors 145, 147, 149, 151 are each communication with one of the first towel roller 121, second towel roller 125, third towel roller 131, and fourth towel roller 133 to rotate each roller based on the user's needs.

In some embodiments, a water pump 153 is in fluid communication with a water reservoir 155 to draw water therefrom and pump the water through water lines 157 connected to sprayers 117.

In some embodiments, an umbrella motor 159 is connected to the umbrella 105 to allow for the user to adjust the position of the umbrella shaft 161 and/or the canopy 113.

In some embodiments, a battery 163 is in electrical communication with each of the umbrella motor 159, towel roller motors 145, 147, 149, 151, a frame motor 143, and water pump 153 to provide sufficient power thereto. Further, the battery 163 is in electrical communication with the display 119. In some embodiments, the battery 163 may instead be a power supply such that the multifunctional lounge chair is connectable to grid power. Alternatively, the battery 163 may be in electrical communication with one or more solar cells.

In some embodiments, the padding 103 is provided as a waterproof mattress or set of mattresses. The padding 103 may be constructed a waterproof material or be provided with a waterproof coating such that the padding 103 is resistant to rain or moisture. This may be especially beneficial if the multifunctional lounge chair 100 is provided to users near a pool or at the beach.

Figure 3:
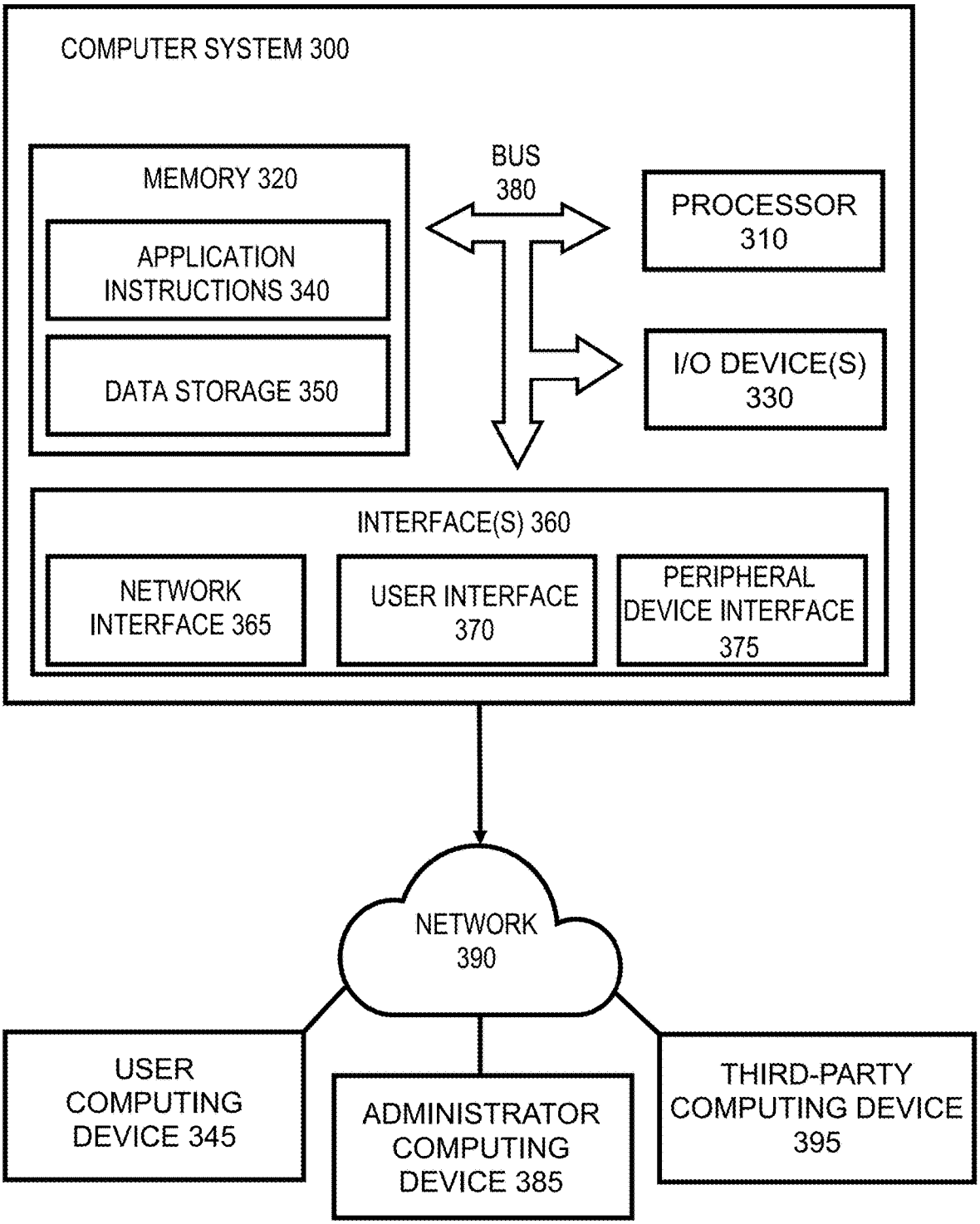
FIG. 3 illustrates a block diagram of the computer system architecture, according to some embodiments.

FIG. 3 illustrates an example of a computer system 300 that may be utilized to execute various procedures, including the processes described herein. The computer system 300 comprises a standalone computer or mobile computing device, a mainframe computer system, a workstation, a network computer, a desktop computer, a laptop, or the like. The computing device 300 can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive).

In some embodiments, the computer system 300 includes one or more processors 310 coupled to a memory 320 through a system bus 380 that couples various system components, such as an input/output (I/O) devices 330, to the processors 310. The bus 380 may be any of several types of bus structures including a memory bus or memory controller, a peripheral bus, and a local bus using any of a variety of bus architectures. For example, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus, also known as Mezzanine bus.

In some embodiments, the computer system 300 includes one or more input/output (I/O) devices 130, such as video device(s) (e.g., a camera), audio device(s), and display(s) are in operable communication with the computer system 300.

In some embodiments, similar I/O devices 130 may be separate from the computer system 300 and may interact with one or more nodes of the computer system 100 through a wired or wireless connection, such as over a network interface.

Processors 310 suitable for the execution of computer readable program instructions include both general and special purpose microprocessors and any one or more processors of any digital computing device. For example, each processor 310 may be a single processing unit or a number of processing units and may include single or multiple computing units or multiple processing cores. The processor (s) 310 can be implemented as one or more microprocessors, microcomputers, microcontrollers, digital signal processors, central processing units, state machines, logic circuitries, and/or any devices that manipulate signals based on operational instructions. For example, the processor(s) 310 may be one or more hardware processors and/or logic circuits of any suitable type specifically programmed or configured to execute the algorithms and processes described herein. The processor(s) 310 can be configured to fetch and execute computer readable program instructions stored in the computer-readable media, which can program the processor(s) 310 to perform the functions described herein.

In this disclosure, the term "processor" can refer to substantially any computing processing unit or device, including single-core processors, single-processors with software multithreading execution capability, multi-core processors, multi-core processors with software multithreading execution capability, multi-core processors with hardware multithread technology, parallel platforms, and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Further, processors can exploit nano-scale architectures, such as molecular and quantum-dot based transistors, switches, and gates, to optimize space usage or enhance performance of user equipment. A processor can also be implemented as a combination of computing processing units.

In some embodiments, the memory 320 includes computer-readable application instructions 350, configured to implement certain embodiments described herein, and a database 350, comprising various data accessible by the application instructions 340. In some embodiments, the application instructions 340 include software elements corresponding to one or more of the various embodiments described herein. For example, application instructions 340 may be implemented in various embodiments using any desired programming language, scripting language, or combination of programming and/or scripting languages (e.g., Android, C, C++, C#, JAVA, JAVASCRIPT, PERL, etc.).

In this disclosure, terms "store," "storage," "data store," data storage," "database," and substantially any other information storage component relevant to operation and functionality of a component are utilized to refer to "memory components," which are entities embodied in a "memory," or components comprising a memory. Those skilled in the art would appreciate that the memory and/or memory components described herein can be volatile memory, nonvolatile memory, or both volatile and nonvolatile memory. Nonvolatile memory can include, for example, read only memory (ROM), programmable ROM (PROM), electrically programmable ROM (EPROM), electrically erasable ROM (EEPROM), flash memory, or nonvolatile random access memory (RAM) (e.g., ferroelectric RAM (FeRAM). Volatile memory can include, for example, RAM, which can act as external cache memory. The memory and/or memory components of the systems or computer-implemented methods can include the foregoing or other suitable types of memory.

Generally, a computing device will also include, or be operatively coupled to receive data from or transfer data to, or both, one or more mass data storage devices; however, a computing device need not have such devices. The computer readable storage medium (or media) can be a tangible device that can retain and store instructions for use by an instruction execution device. The computer readable storage medium can be, for example, an electronic storage device, a magnetic storage device, an optical storage device, an electromagnetic storage device, a semiconductor storage device, or any suitable combination of the foregoing. A non-exhaustive list of more specific examples of the computer readable storage medium can include: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. In this disclosure, a computer readable storage medium is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

In some embodiments, the steps and actions of the application instructions 340 described herein are embodied directly in hardware, in a software module executed by a processor, or in a combination of the two. A software module may reside in RAM, flash memory, ROM memory, EPROM memory, EEPROM memory, registers, a hard disk, a removable disk, a CD-ROM, or any other form of storage medium known in the art. An exemplary storage medium may be coupled to the processor 310 such that the processor 310 can read information from, and write information to, the storage medium. In the alternative, the storage medium may be integrated into the processor 110. Further, in some embodiments, the processor 310 and the storage medium may reside in an Application Specific Integrated Circuit (ASIC). In the alternative, the processor and the storage medium may reside as discrete components in a computing device. Additionally, in some embodiments, the events or actions of a method or algorithm may reside as one or any combination or set of codes and instructions on a machine-readable medium or computer-readable medium, which may be incorporated into a computer program product.

In some embodiments, the application instructions 340 for carrying out operations of the present disclosure can be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The application instructions 340 can execute entirely on the user's computer, partly on the user's computer, as a stand-alone software package, partly on the user's computer and partly on a remote computer, or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some embodiments, electronic circuitry including, for example, programmable logic circuitry, field-programmable gate arrays (FPGA), or programmable logic arrays (PLA) can execute the computer readable program instructions by utilizing state information of the computer readable program instructions to personalize the electronic circuitry, in order to perform aspects of the present disclosure.

In some embodiments, the application instructions 340 can be downloaded to a computing/processing device from a computer readable storage medium, or to an external computer or external storage device via a network 390. A network adapter card or network interface in each computing/processing device receives computer readable program instructions from the network and forwards the computer readable application instructions 340 for storage in a computer readable storage medium within the respective computing/processing device.

In some embodiments, the computer system 300 includes one or more interfaces 360 that allow the computer system 300 to interact with other systems, devices, or computing environments. In some embodiments, the computer system 300 comprises a network interface 365 to communicate with a network 390. In some embodiments, the network interface 365 is configured to allow data to be exchanged between the computer system 300 and other devices attached to the network 390, such as other computer systems, or between nodes of the computer system 300. In various embodiments, the network interface 365 may support communication via wired or wireless general data networks, such as any suitable type of Ethernet network, for example, via telecommunications/telephony networks such as analog voice networks or digital fiber communications networks, via storage area networks such as Fiber Channel SANs, or via any other suitable type of network and/or protocol. Other interfaces include the user interface 370 and the peripheral device interface 375.

In some embodiments, the network 390 corresponds to a local area network (LAN), wide area network (WAN), the Internet, a direct peer-to-peer network (e.g., device to device Wi-Fi, Bluetooth, etc.), and/or an indirect peer-to-peer network (e.g., devices communicating through a server, router, or other network device). The network 390 can comprise copper transmission cables, optical transmission fibers, wireless transmission, routers, firewalls, switches, gateway computers and/or edge servers. The network 390 can represent a single network or multiple networks. In some embodiments, the network 390 used by the various devices of the computer system 300 is selected based on the proximity of the devices to one another or some other factor. For example, when a first user device and second user device are near each other (e.g., within a threshold distance, within direct communication range, etc.), the first user device may exchange data using a direct peer-to-peer network. But when the first user device and the second user device are not near each other, the first user device and the second user device may exchange data using a peer-to-peer network (e.g., the Internet). The Internet refers to the specific collection of networks and routers communicating using an Internet Protocol ("IP") including higher level protocols, such as Transmission Control Protocol/Internet Protocol ("TCP/IP") or the Uniform Datagram Packet/Internet Protocol ("UDP/IP").

Any connection between the components of the system may be associated with a computer-readable medium. For example, if software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. As used herein, the terms "disk" and "disc" include compact disc (CD), laser disc, optical disc, digital versatile disc (DVD), floppy disk, and Blu-ray disc; in which "disks" usually reproduce data magnetically, and "discs" usually reproduce data optically with lasers. Combinations of the above should also be included within the scope of computer-readable media. In some embodiments, the computer-readable media includes volatile and nonvolatile memory and/or removable and non-removable media implemented in any type of technology for storage of information, such as computer-readable instructions, data structures, program modules, or other data. Such computer-readable media may include RAM, ROM, EEPROM, flash memory or other memory technology, optical storage, solid state storage, magnetic tape, magnetic disk storage, RAID storage systems, storage arrays, network attached storage, storage area networks, cloud storage, or any other medium that can be used to store the desired information and that can be accessed by a computing device. Depending on the configuration of the computing device, the computer-readable media may be a type of computer-readable storage media and/or a tangible non-transitory media to the extent that when mentioned, non-transitory computer-readable media exclude media such as energy, carrier signals, electromagnetic waves, and signals per se.

In some embodiments, the system is world-wide-web (www) based, and the network server is a web server delivering HTML, XML, etc., web pages to the computing devices. In other embodiments, a client-server architecture may be implemented, in which a network server executes enterprise and custom software, exchanging data with custom client applications running on the computing device.

In some embodiments, the system can also be implemented in cloud computing environments. In this context, "cloud computing" refers to a model for enabling ubiquitous, convenient, on-demand network access to a shared pool of configurable computing resources (e.g., networks, servers, storage, applications, and services) that can be rapidly provisioned via virtualization and released with minimal management effort or service provider interaction, and then scaled accordingly. A cloud model can be composed of various characteristics (e.g., on-demand self-service, broad network access, resource pooling, rapid elasticity, measured service, etc.), service models (e.g., Software as a Service ("SaaS"), Platform as a Service ("PaaS"), Infrastructure as a Service ("IaaS"), and deployment models (e.g., private cloud, community cloud, public cloud, hybrid cloud, etc.).

As used herein, the term "add-on" (or "plug-in") refers to computing instructions configured to extend the functionality of a computer program, where the add-on is developed specifically for the computer program. The term "add-on data" refers to data included with, generated by, or organized by an add-on. Computer programs can include computing instructions, or an application programming interface (API) configured for communication between the computer program and an add-on. For example, a computer program can be configured to look in a specific directory for add-ons developed for the specific computer program. To add an add-on to a computer program, for example, a user can download the add-on from a website and install the add-on in an appropriate directory on the user's computer.

In some embodiments, the computer system 300 may include a user computing device 345, an administrator computing device 385 and a third-party computing device 395 each in communication via the network 390. The administrator computing device 385 is utilized by an administrative user to moderate content and to perform other administrative functions. The third-party computing device 395 may be utilized by third parties to receive communications from the user computing device, transmit communications to the user via the network, and otherwise interact with the various functionalities of the system.

Figure 4:
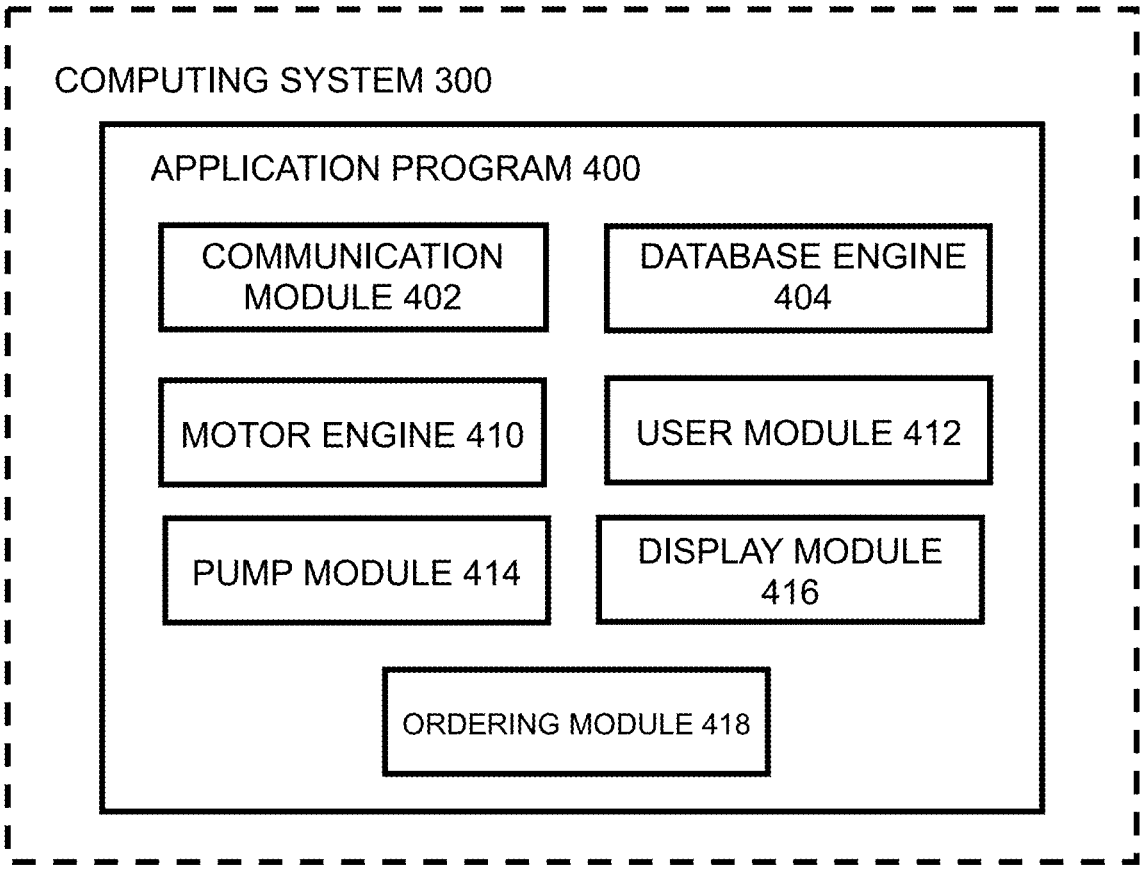
FIG. 4 illustrates a block diagram of the databases and application program, according to some embodiments.

FIG. 4 illustrates an example computer architecture for the application program 400 operated via the computing system 300. The computer system 300 comprises several modules and engines configured to execute the functionalities of the application program 400, and a database engine 404 configured to facilitate how data is stored and managed in one or more databases. In particular, FIG. 4 is a block diagram showing the modules and engines needed to perform specific tasks within the application program 200.

Referring to FIG. 4, the computing system 300 operating the application program 400 comprises one or more modules having the necessary routines and data structures for performing specific tasks, and one or more engines configured to determine how the platform manages and manipulates data. In some embodiments, the application program 400 comprises one or more of a communication module 402, a database engine 404, a motor module 410, a user module 412, a pump module 414, a display module 416, and an ordering module 418.

In some embodiments, the communication module 402 is configured for receiving, processing, and transmitting a user command and/or one or more data streams. In such embodiments, the communication module 402 performs communication functions between various devices, including the user computing device 345, the administrator computing device 385, and a third-party computing device 395. In some embodiments, the communication module 402 is configured to allow one or more users of the system, including a third-party, to communicate with one another. In some embodiments, the communications module 402 is configured to maintain one or more communication sessions with one or more servers, the administrative computing device 385, and/or one or more third-party computing device(s) 395.

In some embodiments, the communication module 402 enables the communication between the tablet and an ordering system provided via the ordering module 418. The ordering system may be associated with a bar, a restaurant, a hotel, or another service provider. In such, the user can select from one or more items (e.g., a food item, a beverage, or a service) which is provided by the service provider. The tablet may be associated with a location or other identification number which indicates to the service provider which user and which multifunctional lounge chair placed the order.

In some embodiments, a database engine 204 is configured to facilitate the storage, management, and retrieval of data to and from one or more storage mediums, such as the one or more internal databases described herein. In some embodiments, the database engine 204 is coupled to an external storage system. In some embodiments, the database engine 204 is configured to apply changes to one or more databases. In some embodiments, the database engine 204 comprises a search engine component for searching through thousands of data sources stored in different locations.

In some embodiments, the database engine 204 may be operable to store information related to each operation function such that users may input settings and preferences.

In some embodiments, the motor module 210 and pump module 214 enable the user to select various operational functions associated with each motor and pump. In such, the user may control the orientation and position of the frame and/or umbrella, the dispensing of towels, and the emission of mist from the misting system. For example, the motor module 210 may be in communication with each towel motor to enable the user to select to dispense a new clean towel or remove a dirty towel.

In some embodiments, the user module 212 facilitates the creation of a user account for the application system. The user account may permit the user to input user information, input payment information associated with the user, user preferences, etc.

In some embodiments, the display module 216 is configured to display one or more graphic user interfaces, including, e.g., one or more user interfaces, one or more consumer interfaces, one or more video presenter interfaces, etc. In some embodiments, the display module 216 is configured to temporarily generate and display various pieces of information in response to one or more commands or operations. The various pieces of information or data generated and displayed may be transiently generated and displayed, and the displayed content in the display module 216 may be refreshed and replaced with different content upon the receipt of different commands or operations in some embodiments. In such embodiments, the various pieces of information generated and displayed in a display module 216 may not be persistently stored.

The display module 216 may enable the user to select various operation functions as described hereinabove, as well as to interact in various manners with the multifunctional lounge chair and associated application programs.

In this disclosure, the various embodiments are described with reference to the flowchart illustrations and/or block diagrams of multifunctional lounge chair assembly, methods of use, apparatus (systems), and computer program products.

Those skilled in the art would understand that each block of the flowchart illustrations and/or block diagrams, and combinations of blocks in the flowchart illustrations and/or block diagrams, can be implemented by computer readable program instructions. The computer readable program instructions can be provided to a processor of a general purpose computer, special purpose computer, or other programmable data processing apparatus to produce a machine, such that the instructions, which execute via the processor of the computer or other programmable data processing apparatus, create means for implementing the functions or acts specified in the flowchart and/or block diagram block or blocks. The computer readable program instructions can be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks. The computer readable program instructions can be loaded onto a computer, other programmable data processing apparatus, or other device to cause a series of operational acts to be performed on the computer, other programmable apparatus, or other device to produce a computer implemented process, such that the instructions that execute on the computer, other programmable apparatus, or other device implement the functions or acts specified in the flowchart and/or block diagram block or blocks.

In this disclosure, the block diagrams in the Figures illustrate the architecture, functionality, and operation of possible implementations of systems, methods, and computer program products according to the various embodiments. Each block in the flowchart or block diagrams can represent a module, segment, or portion of instructions, which comprises one or more executable instructions for implementing the specified logical function(s). In some embodiments, the functions noted in the blocks can occur out of the order noted in the Figures. For example, two blocks shown in succession can, in fact, be executed concurrently or substantially concurrently, or the blocks can sometimes be executed in the reverse order, depending upon the functionality involved. In some embodiments, each block of the block diagrams and/or flowchart illustration, and combinations of blocks in the block diagrams and/or flowchart illustration, can be implemented by a special purpose hardware-based system that performs the specified functions or acts or carry out combinations of special purpose hardware and computer instructions.

In this disclosure, the subject matter has been described in the general context of computer-executable instructions of a computer program product running on a computer or computers, and those skilled in the art would recognize that this disclosure can be implemented in combination with other program modules. Generally, program modules include routines, programs, components, data structures, etc. that perform particular tasks and/or implement particular abstract data types. Those skilled in the art would appreciate that the computer-implemented methods disclosed herein can be practiced with other computer system configurations, including single-processor or multiprocessor computer systems, mini-computing devices, mainframe computers, as well as computers, hand-held computing devices (e.g., PDA, phone), microprocessor-based or programmable consumer or industrial electronics, and the like. The illustrated embodiments can be practiced in distributed computing environments where tasks are performed by remote processing devices that are linked through a communications network. Some embodiments of this disclosure can be practiced on a stand-alone computer. In a distributed computing environment, program modules can be located in both local and remote memory storage devices.

In this disclosure, the terms "component," "system," "platform," "interface," and the like, can refer to and/or include a computer-related entity or an entity related to an operational machine with one or more specific functionalities. The disclosed entities can be hardware, a combination of hardware and software, software, or software in execution. For example, a component can be a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As another example, a component can be an apparatus that provides specific functionality through electronic components without mechanical parts, wherein the electronic components can include a processor or other means to execute software or firmware that confers at least in part the functionality of the electronic components. In some embodiments, a component can emulate an electronic component via a virtual machine, e.g., within a cloud computing system.

The phrase "application" as is used herein means software other than the operating system, such as Word processors, database managers, Internet browsers and the like. Each application generally has its own user interface, which allows a user to interact with a particular program. The user interface for most operating systems and applications is a graphical user interface (GUI), which uses graphical screen elements, such as windows (which are used to separate the screen into distinct work areas), icons (which are small images that represent computer resources, such as files), pull-down menus (which give a user a list of options), scroll bars (which allow a user to move up and down a window) and buttons (which can be "pushed" with a click of a mouse). A wide variety of applications is known to those in the art.

The phrases "Application Program Interface" and API as are used herein mean a set of commands, functions and/or protocols that computer programmers can use when building software for a specific operating system. The API allows programmers to use predefined functions to interact with an operating system, instead of writing them from scratch. Common computer operating systems, including Windows, Unix, and the Mac OS, usually provide an API for programmers. An API is also used by hardware devices that run software programs. The API generally makes a programmer's job easier, and it also benefits the end user since it generally ensures that all programs using the same API will have a similar user interface.

The phrase "central processing unit" as is used herein means a computer hardware component that executes individual commands of a computer software program. It reads program instructions from a main or secondary memory, and then executes the instructions one at a time until the program ends. During execution, the program may display information to an output device such as a monitor.

The term "execute" as is used herein in connection with a computer, console, server system or the like means to run, use, operate or carry out an instruction, code, software, program and/or the like.

In this disclosure, the descriptions of the various embodiments have been presented for purposes of illustration and are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein. Thus, the appended claims should be construed broadly, to include other variants and embodiments, which may be made by those skilled in the art.

What is claimed is:

1. A multifunctional lounge chair, comprising:

a frame;

a padding positioned on the frame;

a misting system to emit a mist to an environment near the frame;

a first towel roller to transport a clean towel over a surface of the padding and a second towel roller to transport a dirty towel off of the surface of the padding;

a third towel roller to transport a clean towel over the surface of the padding and a fourth towel roller to transport a dirty towel off of the surface of the padding; and a tablet to provide a user interface to enable to control a plurality of operational functions of the multifunctional lounge chair.

2. The multifunctional lounge chair of claim 1, wherein the tablet is in communication with an ordering system to enable the user to select one or more items to order.

3. The multifunctional lounge chair of claim 2, further comprising a massage mat disposed within or covering at least a portion of the padding.

4. The multifunctional lounge chair of claim 3, wherein the misting system is comprised of:

a reservoir to store water;

a water pump to pump water from the reservoir through at least one water line to a plurality of sprayers to emit mist therefrom.

5. The multifunctional lounge chair of claim 4, further comprising a first towel motor to roll the first towel roller.

6. The multifunctional lounge chair of claim 5, further comprising a second towel motor to roll the second towel roller.

7. The multifunctional lounge chair of claim 6, further comprising a power storage device to store power and to supply power to at least one of the following: the first towel motor, the second towel motor, the water pump, the massage mat, and the tablet.

8. A multifunctional lounge chair, comprising:

a frame comprising a top portion and a bottom portion;

an upper padding to at least partially cover the top portion and a lower padding to at least partially cover the bottom portion;

an umbrella adjustably mounted to a central portion of the frame, the umbrella adjustable via an umbrella motor to adjust the orientation of the umbrella;

a misting system comprising a water reservoir and a water pump, the water pump to draw water from the water reservoir and emit a mist through a plurality of sprinklers;

a first towel roller to transport a clean towel over an upper portion of the padding and a second towel roller to transport a dirty towel off of the upper portion of the padding;

a third towel roller to transport a clean towel over a lower portion of the padding and a fourth towel roller to transport a dirty towel off of the lower portion of the padding;

a massage system to provide a massage sensation to at least one of a top surface and a bottom surface; and a tablet to provide a user interface to enable to control a plurality of operational functions of the multifunctional lounge chair.

9. The multifunctional lounge chair of claim 8, further comprising a computer system in operable communication with an application program operated via the tablet.

10. The multifunctional lounge chair of claim 9, wherein the application program is comprised of a communication module to enable the user to communicate with a service provider to order a good or a service.

11. The multifunctional lounge chair of claim 10, wherein the application program further comprises a motor module and a pump module.

12. A multifunctional lounge chair system, comprising:

a frame;

a padding positioned on the frame;

an umbrella adjustably mounted to the frame;

a misting system to emit a mist to an environment near the frame;

a first towel roller to transport a clean towel over the surface of the padding;

a second towel roller to transport a dirty towel off of the surface of the padding;

a third towel roller to transport a clean towel over the surface of the padding and a fourth towel roller to transport a dirty towel off of the surface of the padding;

a tablet in operable communication with a computer system operating an application program, the application program accessible via a user interface provided by the tablet, the user interface providing a plurality of selectable and adjustable operational functions associated with the multifunctional lounge chair system;

an ordering module in communication with the tablet to enable the user to select from a plurality of items to order from a service provider.

13. The multifunctional lounge chair system of claim 12, wherein the tablet is in communication with an ordering system to enable the user to select one or more items to order.

14. The multifunctional lounge chair system of claim 13, further comprising a massage mat disposed within or covering at least a portion of the padding.

15. The multifunctional lounge chair system of claim 14, wherein the misting system is comprised of:

a reservoir to store water;

a water pump to pump water from the reservoir through at least one water line to a plurality of sprayers to emit mist therefrom.

16. The multifunctional lounge chair system of claim 15, further comprising a first towel motor to roll the first towel roller.

17. The multifunctional lounge chair system of claim 16, further comprising a second towel motor to roll the second towel roller.

18. The multifunctional lounge chair system of claim 17, further comprising a power storage device to store power and to supply power to at least one of the following: the first towel motor, the second towel motor, the water pump, the massage mat, and the tablet.

19. The multifunctional lounge chair system of claim 18, further comprising a motor module in operable communication with the tablet, wherein the motor module enables a selection of one or more operational functions associated with at least one of the following: the first towel motor, the second towel motor, a third towel motor, a fourth towel motor, a frame motor, and an umbrella motor.

20. The multifunctional lounge chair system of claim 19, further comprising a pump module to enable the user to select an operation function associated with the water pump.

* * * * *